United States Patent [19]

Schallert

[11] 4,308,855

[45] Jan. 5, 1982

[54] SUBMERGED BURNER FURNACE

[76] Inventor: Joseph M. Schallert, 11737 Old St. Charles Rd., Bridgeton, Mo. 63044

[21] Appl. No.: 738,436

[22] Filed: Nov. 3, 1976

[51] Int. Cl.[3] ..... F24H 1/20

[52] U.S. Cl. ..... 126/360 A

[58] Field of Search ..... 126/360; 23/307, 275; 159/16 A

[56] References Cited

U.S. PATENT DOCUMENTS

| | | | |
|---|---|---|---|
| 609,357 | 8/1898 | Lindemeyr | 126/360 R |
| 690,303 | 12/1901 | Legge | 159/16 A |
| 2,159,759 | 5/1939 | Doennecke et al. | 126/360 A |
| 2,233,675 | 3/1941 | Marten | 126/360 A |
| 2,358,302 | 9/1944 | Brosius | 126/360 A |
| 3,209,745 | 10/1965 | Glaser et al. | 126/360 A X |
| 3,407,805 | 10/1968 | Bougard | 126/360 A |
| 3,568,658 | 3/1971 | Bruck | 126/360 A |

FOREIGN PATENT DOCUMENTS

| | | | |
|---|---|---|---|
| 428142 | 10/1911 | France | 126/360 R |
| 1097029 | 6/1955 | France | 126/360 A |

*Primary Examiner*—Albert J. Makay
*Assistant Examiner*—Harold Joyce
*Attorney, Agent, or Firm*—Rogers, Eilers & Howell

[57] ABSTRACT

A direct contact gas-liquid heater has a tank filled with a liquid, a submerged burner and a gas distributor. The heater burns a fuel air mixture producing hot gas which is bubbled up through the liquid. A system of liquid level raising and lowering pods or a bellows and reservoir prevents the liquid from sumping back through the gas distribution system to drown the burner when the burner is shut off. The heater has a vacuum pump in the exhaust conduit to create a continuous draft for the gas bubbling up through the liquid and baffles to disentrain liquid from the exhaust gases.

10 Claims, 7 Drawing Figures

FIG. 1.
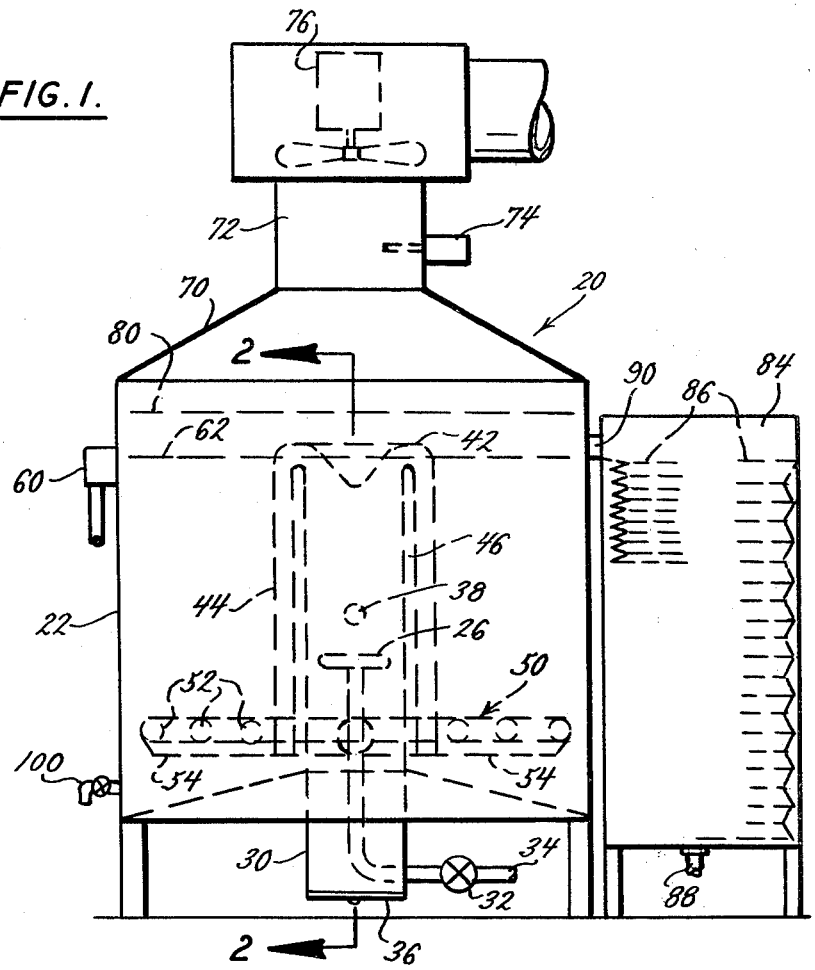
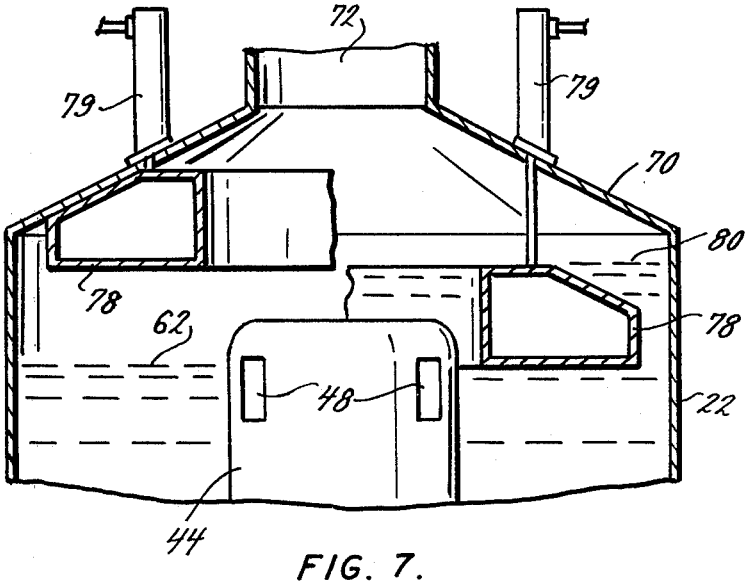
FIG. 7.

FIG. 2.
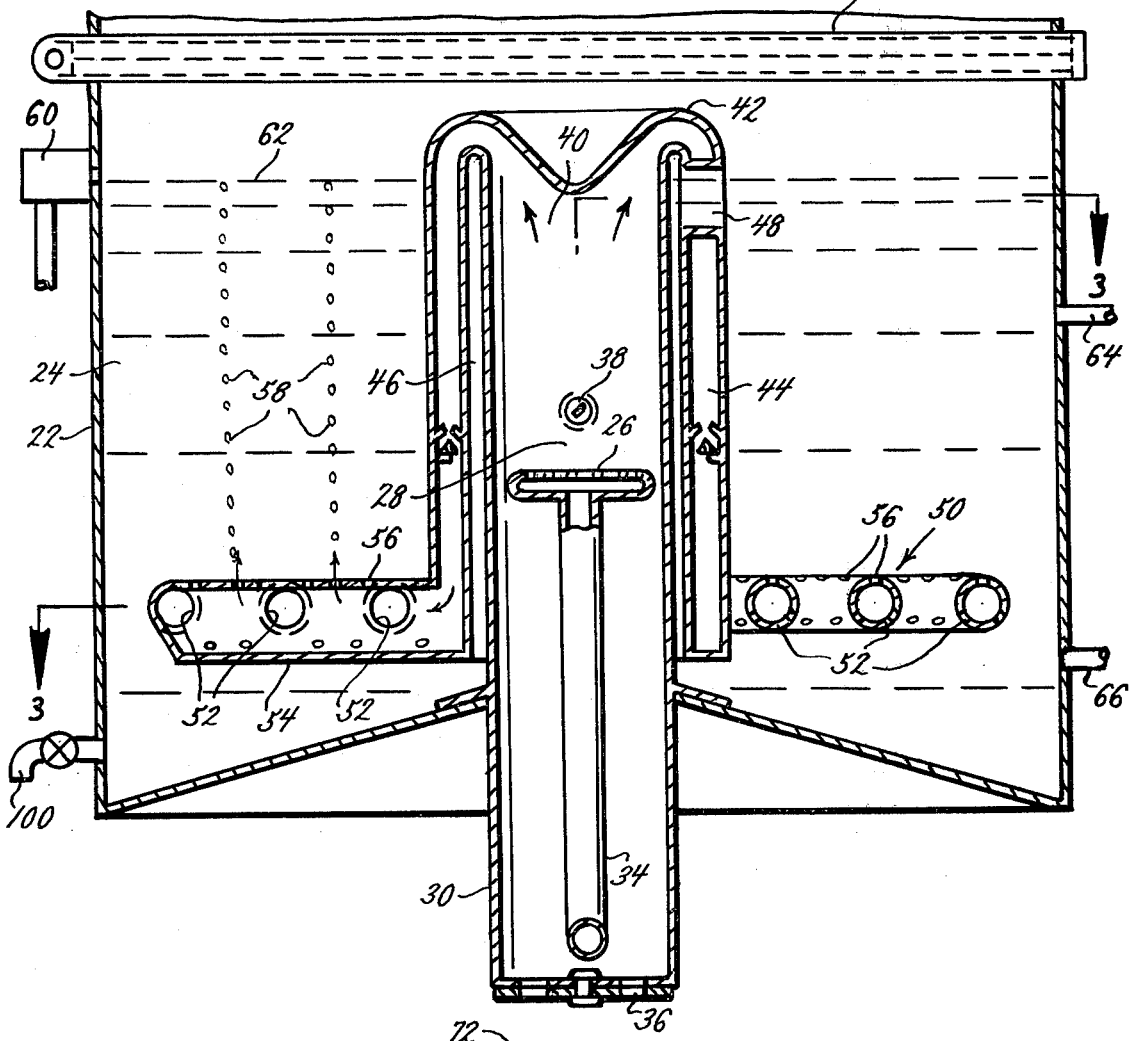
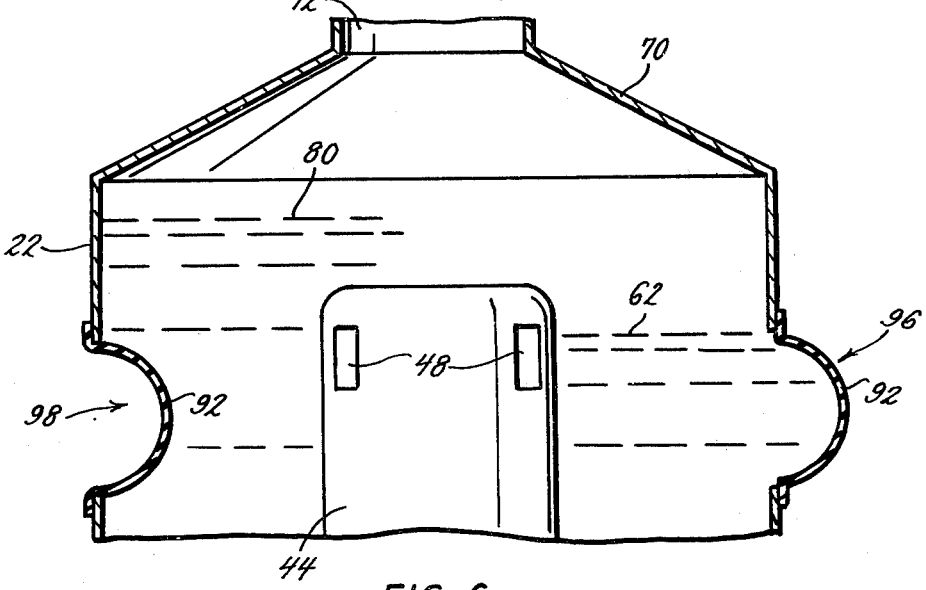
FIG. 6.

FIG. 3.
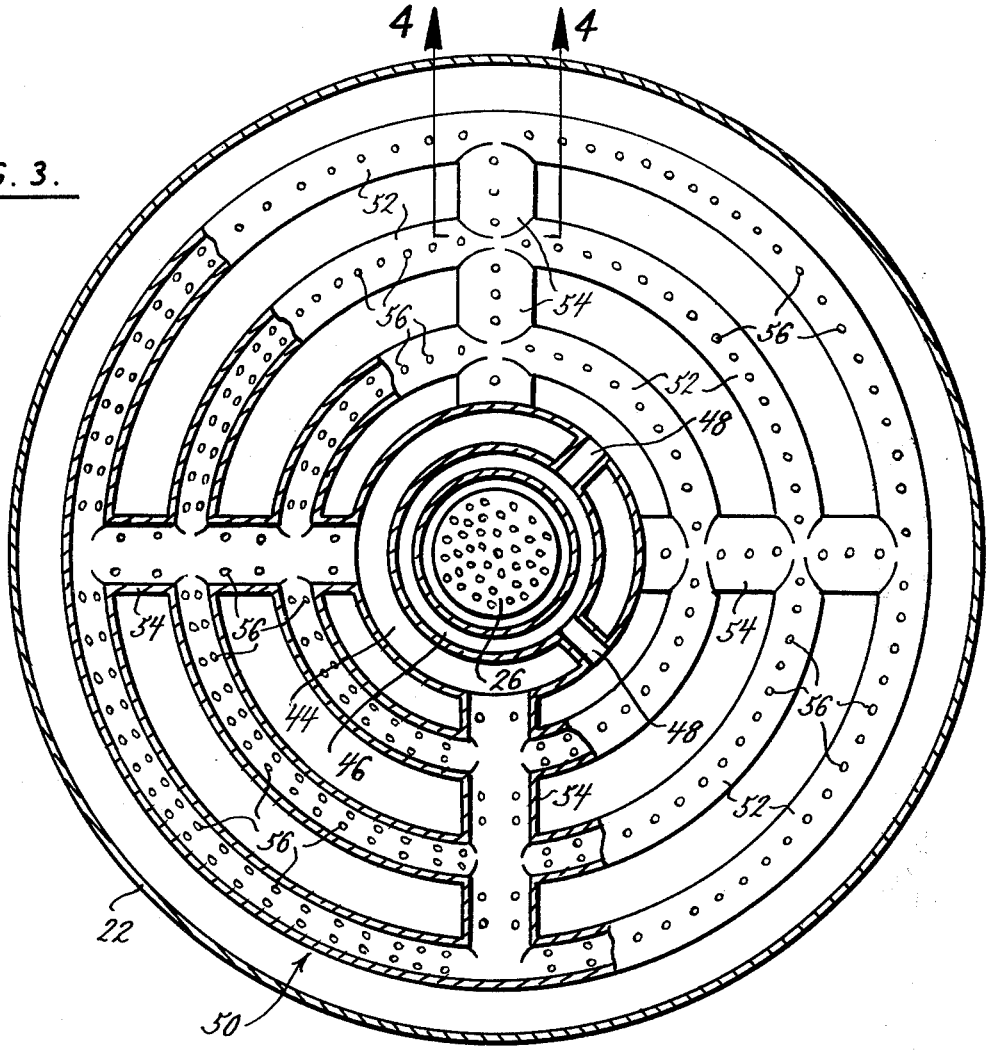
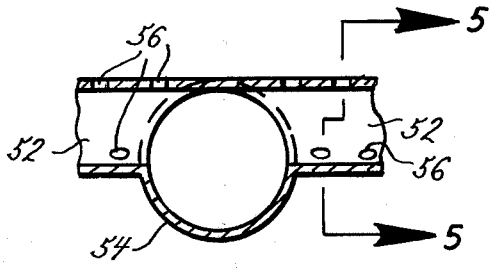
FIG. 4.
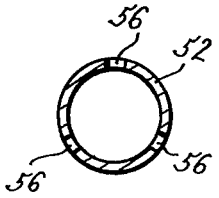
FIG. 5.

SUBMERGED BURNER FURNACE

BACKGROUND AND SUMMARY OF THE INVENTION

Direct contact gas-liquid heating devices are generally known in the prior art. In a typical device, fuel is burned in a combustion chamber to produce heated gases which then bubble up through a liquid medium giving up a portion of their heat to the medium. Some known configurations locate a combustion chamber or burner can in the liquid medium. A burner is located within the combustion chamber and a mixture of fuel and air is piped into the burner and ignited. In this configuration radiation heat is directly absorbed by the liquid medium, which also serves to cool the combustion chamber or burner can.

In direct contact heaters, it is desirable to introduce the heat gases into the liquid medium at the lowest possible level to provide a longer path for the bubbles to travel and hence more efficiently transfer the heat from the gas to the liquid medium. Some configurations accomplish this by inverting the burner within the combustion chamber. The combustion gases flow to the bottom of a surrounding tank and bubble upwardly through a liquid medium in the tank. However, there is a tendency for the liquid medium to sump back through the distribution system and drown the burner when the heater is shut off in this construction. This is especially a problem in applications which require the heater to cycle off and on periodically, such as in a home heating system or hot water heating system.

There are some configurations which utilize an upwright flame, but these systems are not nearly as successful in conveying the heated gases to the bottom of the liquid medium for distribution and bubbling. These systems normally depend upon maintenance of the liquid medium level within close tolerances; low enough to prevent the sumping as previously discussed, but high enough to keep the bubble distribution structure in contact with the liquid medium. This structure is less efficient since the liquid level must be lower than the top of the burner.

There are other configurations which utilize more than one liquid medium, by pumping a second liquid through pipes in the direct contact heater tank. These are not nearly as efficient as devices using one liquid medium because the second liquid medium is in indirect thermal contact through the walls of the pipes with the first liquid medium. This reduces the rate of heat exchange.

The efficiency of direct contact gas liquid heaters is generally a function of the size of the bubbles and the degree of mixing obtained before the gas escapes the medium. Obviously, the smaller the bubbles and the greater the degree of mixing, the higher the efficiency and the exchange of heat from the gases to the medium. In an ideal direct contact heater, the temperature of the gases leaving the medium would be the same as the temperature of the medium.

Applicant has succeeded in developing a device which maximizes efficiency of heat exchange while avoiding the problems associated with the structure used previously. Applicant's device may utilize one liquid medium, an upright flame and burner, a submerged combustion chamber and gas distribution system, and a bubble distribution array which distributes the gas bubbles into the medium at the lowest possible level. A liquid medium level raising and lowering structure may preclude sumping of the medium when the burner is shut off.

Applicant's invention can be more fully understood by referring to the following drawings and the explanation contained in the preferred embodiment.

DESCRIPTION OF THE DRAWINGS

FIG. 1 is a side elevation view of the heating device with bellows;

FIG. 2 is a cross-sectional view of the hot gas plenum and bubble distribution structure taken along line 2—2 in FIG. 1;

FIG. 3 is a top view detailing the hot gas plenum and bubble distribution structure taken along line 3—3 in FIG. 2;

FIG. 4 is a close up cross-sectional view of the bubble distribution structure taken along line 4—4 in FIG. 3;

FIG. 5 is a cross-sectional view of an element in the bubble distribution structure taken along line 5—5 in FIG. 4;

FIG. 6 is a side elevation view of the heating device with contractible boot;

FIG. 7 is a side elevation view of the heating device wwith pods.

DESCRIPTION OF THE PREFERRED EMBODIMENT

Referring to FIG. 1, a direct contact liquid gas heater 20, as used in a home heating system for example, has a tank 22 containing a liquid medium 24 which can be water or any other suitable liquid. A burner 26 in a submerged combustion chamber 28 burns a fuel air mixture entering the combustion chamber 28 through an entry stack 30. The entry stack 30 extends downward from the bottom of the tank 22 and is sealed where it meets the tank 22 to prevent leakage of liquid medium 24.

A fuel control valve 32 controls the rate of fuel flowing to the burner 26 through the fuel inlet conduit 34. Manually adjustable air inlets 36 located in the bottom of the entry stack 30 control the amount of air entering and flowing up into the combustion chamber 28.

A spark igniter 38 in the combustion chamber 28 ignites the fuel air mixture when the heater 20 is turned on.

A hot gas plenum 40 extends upwardly from the combustion chamber 28, narrowing at its top and forming a knee bend 42. A vertical riser flue 44 is formed in the shape of a cylinder and extends downwardly from the knee bend 42 to near the bottom of the tank 22 to surround the combustion chamber 28. An annular space 46 between the vertical riser flue 44 and the combustion chamber 28 is filled with liquid medium 24. Four openings 48 near the top of the vertical riser flue 44 allow the liquid medium 24 to flow up through the annular space 46 and return to the main body of liquid medium 24 in the tank 22.

A bubble distribution array 50 (shown in FIG. 3) attaches to the bottom of the vertical riser flue 44 and has three annular rings 52 and four communicating radial cross members 54. The bubble distribution array 50 has sets of bubble holes 56 which break up the gas into bubbles 58 and distribute the bubbles 58 throughout the liquid medium 24.

Referring to FIG. 5, each set of bubble holes 56 consists of one drilled directly vertical, one at about 120°, and one at about 240° around the circumference of the annular ring 52 or cross member 54. Sets of bubble holes 56 are spaced approximately every quarter inch along the length of the annular rings 52 and cross members 54.

As is shown in FIG. 5, the sets of bubble holes 56 blanket the entire cross sectional area of the tank 22 to provide an even distribution of bubbles 58 and an even heating of the liquid medium 24. Furthermore, as the bubble distribution array 50 is located near the bottom of the tank 22, maximum mixing of gas bubbles 58 and liquid medium 24 is obtained to ensure a high rate of heat exchange in the heater 20.

Steel pipe or any other conventional material can be used to fabricate the bubble distribution array 50 and the other submerged elements. Stainless steels may be preferred in some uses due to their corrosion resistant properties.

A medium level control 60, which may be a float valve, is located near the top of the tank 22 to maintain the liquid medium level 62 in the non-operating mode.

An inlet 64 and an outlet 66 are located in the tank 22 so as to allow circulation of the heated liquid medium 24 to and from an external heat distribution system (not shown).

Disentraining baffles 68 are located near the top of the tank 22 and are positioned so that cooled gas leaving the liquid medium 24 must pass through the baffles 68 before leaving the tank 22.

An exhaust bonnet 70 covers the top of the tank 22. The exhaust bonnet 70 narrows at its top and joins with an exhaust stack 72. The exhaust stack 72 contains an air flow switch 74 which senses the movement of gas within the exhaust stack 72. An exhaust blower 76 is located above the exhaust stack 72 which forcibly draws the exhaust gas out of the tank 22, thereby creating a draft to aid the movement of gas through the heater 20. The exhaust blower 76 is capable of developing approximately 0.5 atmosphere of pressure.

Medium level increasing pods 78 and a lowering mechanism 79, which may be an electric motor driving a pinion and a cooperating rack on the pods, or an equivalent device, are located in the exhaust bonnet 70. These pods 78 are lowered into the liquid medium 24 when the heater 20 is turned on, thereby displacing the liquid medium 24 from the non-operating level 62 to the operating level 80. The pods 78 are constructed of stainless steel or any similar material which is relatively lightweight and will not corrode or deteriorate by coming into contact with the liquid medium 24.

An alternate method for raising the medium 24 non-operating level 62 to the operating level 80 is shown in FIG. 1. This structure is provided in place of the medium level increasing pods 78 and the lowering mechanism and consists of a separate reservoir 84 with a contractible bellows 86 extending down into the separate reservoir 84, an air vent 88, and a connecting opening 90. The bellows 86 contracts to dump liquid medium 24 into the tank 22 through the connecting opening 90 and raises the medium 24 non-operating level 62 to the operating level 80.

A second, and preferred, alternative for raising the medium 24 non-operating level 62 to the operating level 80 is shown in FIG. 6. A contractible boot 92 is positioned in the wall 94 of tank 22. The boot 92 is formed of a flexible material, such as rubber or other suitable elastomer. When the boot 92 is flexed to position 96 the medium 24 in the tank 22 is at non-operating level 62. The partial vacuum produced by operation of blower 76 causes the boot 92 to collapse to position 98 raising the medium 24 to the operating level 80.

At the bottom of the tank 22 is a drain valve 100 to allow periodic cleaning or changing of the liquid medium 24 in the tank 22.

OPERATION OF THE DEVICE

When the direct contact gas-liquid heater 20 is used as a home furnace, operation of the device is as follows. A room thermostat (not shown) senses the need for heat, closes an electrical contact and starts the exhaust blower 76. The exhaust blower 76 creates an air flow in the exhaust stack 72 which is sensed by the air flow switch 74 mounted therein. The air flow switch 74 simultaneously closes electrical contacts to the spark igniter 38 and the fuel control valve 32. However, the fuel control vavle 32 remains closed until the spark igniter control (not shown) closes an electrical contact. When both electric signals are present, the spark igniter 38 turns on and remains on until ignition takes place and then automatically turns off. The air flow switch 74 closes another electrical contact to the lowering mechanism (not shown) which lowers the medium level increasing pods 78 thereby raising the liquid medium from the non-operating level 62 to the operating level 80 and completely submersing the hot gas plenum 40.

The draft from the exhaust blower 76 draws air up into the combustion chamber 28 through the air inlets 36 in the entry stack 30 which mixes with the fuel being emitted from the burner 26. This fuel gas mixture is ignited and produces a continuous flame at the burner 26.

The hot exhaust gas is drawn up from the combustion chamber 28 into the hot gas plenum 40 over the knee bend 42 and down through the vertical riser plenum 44 to the bubble distribution array 50.

The hot exhaust gas is distributed throughout the three annular rings 52 by the four communicating radial cross members 54 so as to reach all the sets of bubble holes 56. The sets of bubble holes 56 break the gas into small bubbles 58 and allow them to escape into the liquid medium 24. As the bubbles 58 rise through the liquid medium 24 they give up their heat so that when they reach the surface they approach the same temperature as the liquid medium 24.

During heater 20 operation, the combustion chamber 28 is cooled by liquid medium 24 entering the bottom of the annular space 46 and circulating up and out the openings 48. This convection current is maintained in the liquid medium 24 by the difference in temperature between the combustion chamber 28 and the liquid medium 24.

When the heater 20 is off, the liquid medium level 62 in the tank 22 is just below the lowest part of the knee bend 42 in the gas plenum 40. This prevents liquid medium 24 from sumping back through the bubble distribution array 50 and up the vertical riser plenum any further than the knee bend 42. This protects the burner 26 from being drowned as well as preventing liquid medium 24 from draining out through the entry stack 30.

When the heater 20 is turned on, the liquid medium 24 is raised to the operating level 80 to fully submerge the gas plenum 40. This allows the heater 20 to operate more efficiently as heat otherwise lost by radiation from the top of the gas plenum 40 is instead absorbed by the surrounding liquid medium 24.

The liquid medium 24 is raised from the non-operating level 62 to the operating level 80 by the medium level increasing pods 78 being lowered into the liquid medium 24 by a lowering mechanism 79 and displacing the liquid medium 24. When the heater 20 is turned off, the increasing pods 78 are automatically retracted by the lowering mechanism and the liquid medium 24 returns to the non-operating level 62.

After the gas bubbles 58 bubble up through and leave the liquid medium 24, they re-form into gas and encounter the disentraining baffles 68. The gas is drawn through and around the baffles 68 in a circuitous manner so that any entrained medium condenses on the cooler baffles 68. These droplets of liquid medium 24 condensing on the baffles 68 coalesce and trickle back down into the tank 22 so as to minimize liquid medium 24 loss.

After the gas passes through the disentraining baffles 68, it is funneled into the exhaust stack 72 by the exhaust bonnet 70. An air flow switch 74 in the exhaust stack 72 senses the movement of gas in the exhaust stack 72 and keeps the fuel valve 32 open.

The exhaust blower 76 draws the gas out of the exhaust stack 72 and provides the draft for any conventional exhaust flue (not shown) as required by the particular installation.

An outlet 66 is located in the side of the tank 22 just at or below the bubble distribution array 50 to circulate heated liquid medium 24 to an external heat distribution system (not shown). The outlet 66 is positioned low enough in the tank 22 so as to preclude any gas from entering the external system but high enough to avoid siphoning any cooler liquid medium 24 or debris that might settle near the bottom of the tank 22. A baffle may be provided over outlet 66 to prevent entrained gases from being circulated to the external heat distribution system, if desired.

Likewise, an inlet 64 is located in the side of the tank 22 just below the non-operating liquid medium level 62 to return the cooled liquid medium 24 from the external system. The inlet 64 is positioned high enough in the tank 22 so that the returning liquid medium 24 will get the full effect of the hot gas bubbles 58 but low enough to prevent the external system from draining into the tank 22 thereby causing sumping in the heater 20 or air pockets in the external system. Inlet 64 may also be baffled, if desired, to prevent gas from escaping into the external heat distribution system.

After the heater 20 runs long enough to raise the temperature in the home above the thermostat setting, the thermostat opens its previously closed electrical contact. The exhaust blower 76 turns off, which greatly diminishes the gas flow in the exhaust stack 72, to turn off the air flow switch 74. The air flow switch 74 opens its previously closed electrical contact to the fuel control valve 32 thereby shutting off the fuel and extinguishing the burner 26. The other electrical contact in the air flow switch 74 opens, which reverses the lowering means and raises the medium level increasing pods 78. The liquid medium 24 thereby returns to the non-operating level 62.

The alternate structure for raising and lowering the liquid medium 24 shown in FIG. 1 operates as follows. When the heater 20 is off, the bellows 86 is filled with liquid medium 24 and extends downward into the separate reservoir 86. When the heater 20 is turned on, the exhaust blower 76 starts up as previously described which creates a partial vacuum above the liquid medium 24. As the air pressure in the vent 88 remains constant at approximately 1 atmosphere, there is a net force developed which collapses the bellows 86 upward, thereby dumping the liquid medium 24 contained therein into the tank 22 through the connecting opening 90. This extra liquid medium 24 is enough to raise the level to the operating level 80. When the heater 20 is turned off, the exhaust blower 76 turns off, the pressure above the liquid medium 24 returns to approximately 1 atmosphere, and the bellows 86 extends down into the separate reservoir 84. Liquid medium 24 then drains through the connecting opening 90 and down into the bellows 86 so as to lower the liquid medium 24 to the non-operating level 62. The connecting opening 90 is located just below the non-operating level 62 to return the liquid medium 24 all the way down to the non-operating level 62 when the heater 20 is turned off. Also, with the connecting opening 90 located in this position, the medium level control 60 can maintain the proper level of liquid medium 24 in the bellows 86 as well as the tank 22. If this alternate structure is used, there is no need for the air flow switch 74 to have an electrical contact for the pod lowering mechanism. The operation of bellows 86 could also be assisted by suitable boost pumps or other equivalent mechanisms, if desired.

The alternate structure shown in FIG. 6 operates as follows. When the heater 20 is off, the boot 92 is filled with medium 24 and extends outwardly to position 96. When the heater 20 is turned on, blower 76 creates a partial vacuum above medium 24. The pressure of the external air around boot 92 collapses boot 92 to position 98 displacing medium 24 upwardly from non-operating level 62 to operating level 80. When heater 20 and blower 76 are turned off, the pressure above medium 24 again returns to approximately that of the external air (about one atmosphere). The boot 92 then returns to position 96 and the medium 24 returns to non-operating level 62.

It can be appreciated by one skilled in the art that changes and modifications could be made to the construction and arrangement of the parts without departing from the spirit and scope of applicant's invention. The invention is to be limited only by the scope of the appended claims and the reasonable equivalents thereof.

I claim:

1. A direct contact liquid-gas heater having a tank to contain a liquid medium, means to maintain the liquid medium at a desired level in the tank, a combustion chamber enclosing a burner submerged in the liquid medium, plenum means communicating with the combustion chamber to direct the flow of gases produced by the burner to a distribution means, the distribution means having means to break the gas into streams of bubbles and release them into the liquid medium, "the tank having cooperating means to automatically prevent sumping of the liquid medium through the distribution means and plenum means to reach the combustion chamber," and means in the top of the tank to remove entrained liquid from gas as an exhausting means exhausts it from the tank.

2. The device of claim 1 wherein the means to prevent sumping includes a means to raise and lower the liquid medium level from a level at which no medium sumps in to the combustion chamber when the heater is off to a level at which the plenum means and combustion chamber is completely submerged during heater operation.

3. The device of claim 2 wherein the means to raise and lower the liquid medium level comprises a collapsible means to displace the liquid medium.

4. The device of claim 1 wherein the means to raise and lower the liquid medium level comprises an external reservoir, a bellows, a connecting opening communicating between the external reservoir and the tank, and a vent; whereby the exhausting means lowers the atmospheric pressure in the tank below that in the vent to collapse the bellows and force the liquid medium out of the external reservoir through the connecting opening into the tank.

5. The device of claim 1 wherein an annular space between the plenum means and the combustion chamber and an opening at the top of the annular space through the plenum means communicates with the main body of liquid medium to allow liquid medium to enter the bottom of the space, circulate up through the space and exit through the opening.

6. The device of claim 1 wherein the distribution means comprises a plurality of annular rings and radial communicating cross members, the annular rings and cross-members having a plurality of perforations to create streams of gas bubbles.

7. The device of claim 1 wherein the distribution means is located at a level lower than the burner in the tank.

8. The device of claim 1 further comprising an air flow means to sense the movement of gas drawn out of the tank by the exhaust means.

9. The device of claim 1 wherein the means to maintain the liquid medium level is a float valve and a valve means controls fuel flowing to the burner.

10. The device of claim 1 wherein the tank has means to contain water and is cylindrical in shape with support means to provide space between the bottom of the tank and the supporting surface, an entry stack protruding through and into the bottom of the tank sealed where the entry stack meets and touches the tank and extending upwardly to communicate with the combustion chamber, the entry stack having means to control the flow of air into the bottom of the entry stack, a fuel supply means extending through and into the entry stack and up into the combustion chamber and terminating at the burner, the fuel supply means having a plurality of orifices in the burner to release fuel into the combustion chamber, the orifices being of sufficient size to promote full and complete mixing of fuel emitting from the burner with air flowing up the combustion chamber from the entry stack, means in the combustion chamber to ignite the fuel and air mixture to produce a continuous flame at the burner, a plenum having means to receive hot gas from the burner, the plenum having a vertical riser and means forming a connecting passageway the vertical passageway and the burner, a distribution means communicating with the plenum and having at least one annular ring and at least one radial communicating cross member, each having a plurality of perforations sized to emit streams of bubbles into the water contained in the tank, means to circulate heated water out of the tank for external use and back to the tank for reheating, disentraining means includes several baffles positioned so as to force gas leaving the water through a circuitous path out of the tank, an exhaust bonnet covering the top of the tank containing at least one medium level increasing pod and an upwardly extending exhaust stack with means in the exhaust stack to sense the movement of gas being exhausted out of the tank by an exhausting means into an exhaust flue communicating therewith.

* * * * *